United States Patent [19]

Montgomery et al.

[11] 4,371,095

[45] Feb. 1, 1983

[54] ONE-PIECE CHILD RESISTANT CLOSURE

[75] Inventors: Gary V. Montgomery; Daniel P. McAlinden, both of Evansville, Ind.

[73] Assignee: Sunbeam Plastics Corporation, Evansville, Ind.

[21] Appl. No.: 317,456

[22] Filed: Nov. 2, 1981

[51] Int. Cl.[3] ..... B65D 47/08

[52] U.S. Cl. ..... 222/153; 215/211; 215/235; 220/339; 222/543; 222/517

[58] Field of Search ..... 215/211, 213, 235, 201; 222/153, 543, 556, 517; 220/339

[56] References Cited

U.S. PATENT DOCUMENTS

| | | | |
|---|---|---|---|
| 4,022,352 | 5/1977 | Pehr | 215/153 |
| 4,124,151 | 11/1978 | Hazard | 222/543 |
| 4,172,540 | 10/1979 | Erichson | 215/235 |
| 4,220,262 | 9/1980 | Uhlig et al. | 215/211 |
| 4,236,653 | 12/1980 | Gach | 222/153 |
| 4,244,495 | 1/1981 | Lorscheid et al. | 222/153 |

*Primary Examiner*—George T. Hall

*Attorney, Agent, or Firm*—Fisher, Gerhardt, Crampton & Groh

[57] ABSTRACT

A one piece child resistant closure for containers in which the closure is permanently attached to a container and dispensing of the container contents is through an orifice closed and sealed by a plug. Removing the plug from the orifice requires pressing of the closure in a specific location to expose an edge of a hinged cover permitting gripping and swinging of the cover member and plug to a fully opened position. During pressing to expose a lifting edge, the plug remains in sealing engagement with the dispensing orifice.

11 Claims, 9 Drawing Figures

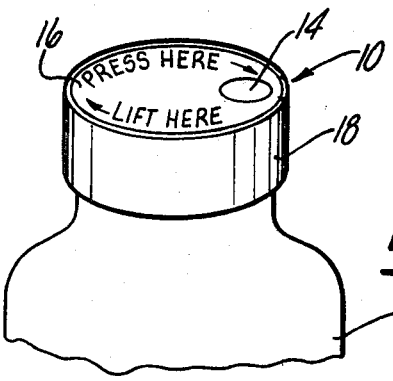
Fig-1
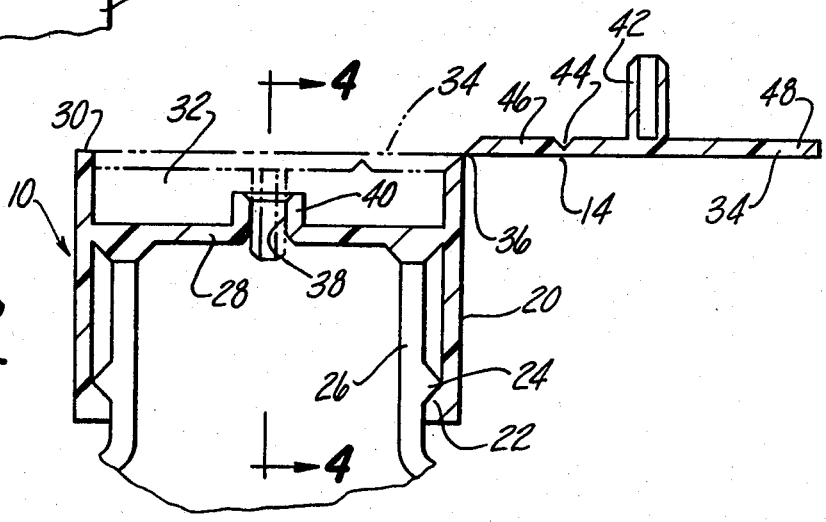
Fig-2
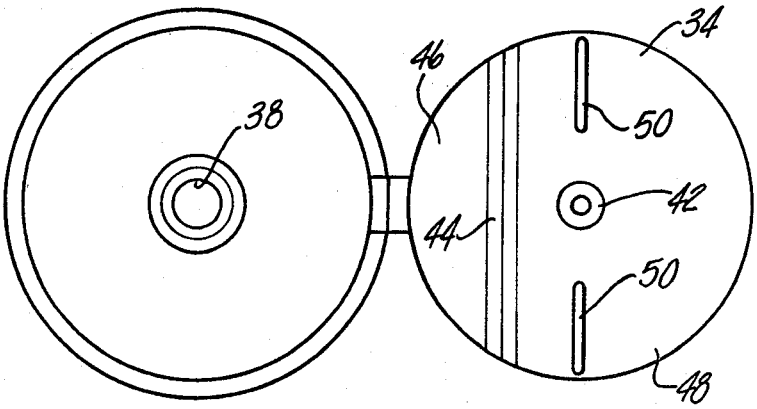
Fig-3
Fig-4
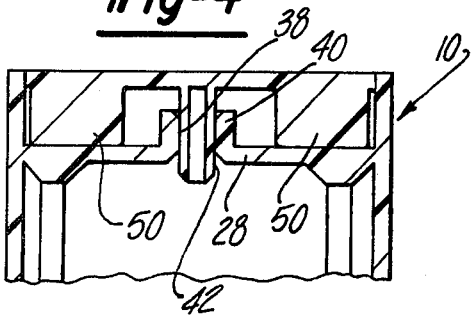
Fig-5
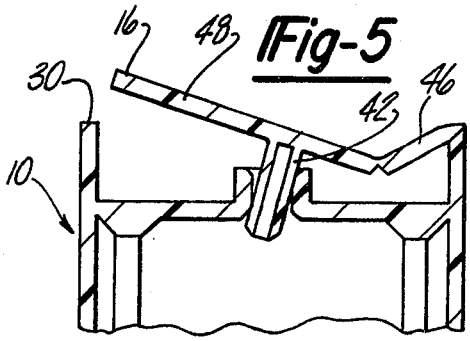

ONE-PIECE CHILD RESISTANT CLOSURE

This invention relates to closures for containers and more particularly to child resistant dispensing closures. There are a wide variety of child resistant closures so called because they are relatively difficult for children to open. To be regarded as child resistant, the closure should be of a type requiring two dissimilar motions or operations to achieve opening and dispensing of the contents of the container. Preferably the two operations should occur simultaneously. Also, dispensing closures of this type are such that the closure is substantially permanently attached to the container and the closure is provided with a normally closed and sealed dispensing opening.

It is an object of the present invention to provide a dispensing closure which requires two dissimilar simultaneous operations to achieve opening.

It is another object of the invention to provide a dispensing closure which remains in closed and sealed condition if only the first of the operations is completed and will automatically return to its original, fully closed position when the first operation is terminated.

Another object of the invention is to provide a child resistant closure which requires pressing downwardly on the top of a closure at a particular location to expose a lifting portion by which the cover can be pivoted to a fully open position for dispensing of the contents of the container.

Yet another object of the invention is to provide a child resistant dispensing closure of the press and lift type in which pressing must be initiated and sustained until lifting begins so that termination of pressing returns the container closure to a fully closed position.

Still a further object of the invention is to provide a child resistant closure of the above type which is made in a single unitary piece from plastic material.

The objects of the invention are accomplished by a one piece child resistant closure including the cap member of the type permanently attached to a container by one-way threads, snap action or other substantially permanently sealing means. The cap member has a recess in its top which is closed by a cover member hinged to the cap member. The cover member is flush with the top of the cap and closes the recess so that no portion of the cover member can be gripped for swinging it about its hinge. A dispensing orifice is formed in the cap within the recess by which the contents of the container can be dispensed. The dispensing orifice is closed by a plug formed on the cover member for movement therewith. A second hinge or deflectable area is formed between the first or primary hinge and the plug so that the cover can be deflected or folded into two portions, one of which is hinged at the primary hinge and a second portion incorporates the plug. A fulcrum is formed in association with the second portion so that application of pressure at the second hinge tilts the second portion of the cover to lift an edge from the recess which can be gripped to swing the entire cover member to a fully opened position in which the plug is removed from the dispensing orifice. The fulcrum is so arranged that pressure on the cover is incapable of applying a lifting or pulling force on the plug so that the plug remains in sealing engagement with the dispensing orifice. During the application of a pressing force on the cover member the tilted cover member distorts the plug or orifice or both in a radial direction which retaining the sealing relationship so that release of the pressing force returns the cover member to its original fully closed position. In one embodiment of the invention the isolation of the plug from the lifting force is accomplished by establishing the fulcrum for the cover member on the same line as the plug and in another embodiment of the invention, it is accomplished by placing the plug on a separate hinged tab moveable relative to the cover member and arranged so that the fulcrum is effective on the cap only and not on the tab.

Presently preferred embodiments of the invention are illustrated in the accompanying drawings in which:

FIG. 1 is a perspective view of a one piece child resistant closure embodying the invention shown in association with a container only the upper end of which is shown;

FIG. 2 is a cross-sectional view of the structure seen in FIG. 1 with the cover member of the closure in a fully opened position relative to a cap member;

FIG. 3 is a plan view of the construction shown in FIG. 2;

FIG. 4 is a cross-sectional view taken on line 4—4 in FIG. 2;

FIG. 5 is a view similar to FIG. 2 but showing the cover member in a lifting position from which the closure can be fully opened;

Figure 6:
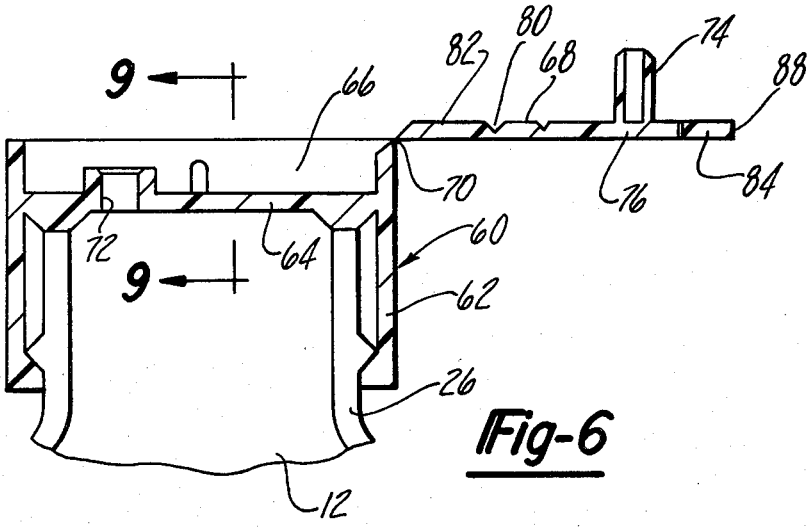
FIG. 6 is a view similar to FIG. 2 showing another embodiment of the invention.
Figure 7:
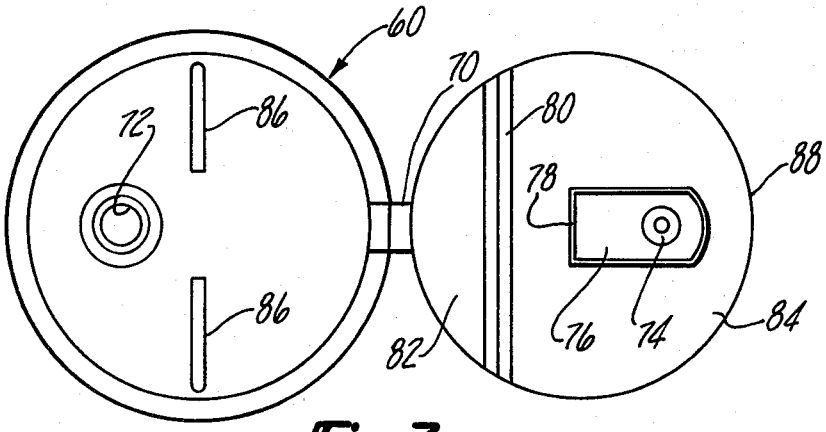
FIG. 7 is a plan view of construction seen in FIG. 6.

A one piece child resistant closure embodying the invention is designated generally at 10 and is permanently attached to a container 12. The closure 10 is of the press and lift type in which the application of pressure at a specific point designated at 14 in FIG. 1 causes an opposite edge 16 to be exposed so that it can be gripped and lifted to open the closure 10.

The closure 10 includes a generally cylindrical cap 18 having a depending skirt 20, the lower edge of which is provided with a bead 22 complementary to an annular flange 24 formed on the neck 26 of the container 12. The cap 18 has a generally disc shaped, flat wall 28 disposed below the upper lip 30 formed at the top of the cylindrical skirt 20. The wall 28 forms a recess 32 which is closed by a cover member 34 which is flush with the upper edge of the lip 30 as shown in phantom line in FIG. 2 so that no exposed portions are available for gripping. The cover member 34 is hinged along one edge as indicated at 36 for swinging movement of the cover member 34 from the full line position shown in FIG. 2 to the phantom line position.

The wall 38 of the cap 18 is provided with a dispensing orifice 38 formed in an annular collar 40 disposed of the disc shaped wall 28. The orifice 38 is adapted to be closed by a plug 42 formed integrally with the cover member 34 so that in the closed position of the closure 10 the plug 42 is disposed in the orifice 38.

The entire closure member is made of a single piece and in the as-molded condition has the configuration illustrated in FIG. 2. Preferably, the closure is made of a plastic material and the dispensing orifice 38 and the plug 42 have an interference fit so that a seal is formed.

After a container 12 has been filled for the first time, the closure 10 is placed in position so that the bead 22 snaps over the annular flange 24 to maintain the closure 10 permanently on the container 12. Other forms of permanent connection such as one-way screw threads or cement also could be used to maintain the closure 10 permanently in position on the container 12.

The cover member 34 is foldable along a groove indicated at 44 which forms a hinge point permitting folding of the cover member 34 into first and second portions 46 and 48 respectively. In addition, as seen in FIGS. 3 and 4, the cover member 34 is provided with a pair of fulcrum elements 50 disposed to opposite sides of the plug 42. In the closed position of the closure 10 as seen in FIG. 4, the fulcrum elements 50 are in engagement with the wall 28 and are disposed at opposite sides of the collar 40 forming the dispensing orifice 38.

In the closed position of the closure 10 as seen in FIGS. 1 and 4, the cover member 34 is flush with the top of the cap 18 so that there are no exposed edges permitting lifting of the cover member 34. Also, the plug 42 is disposed in the orifice 38 to place the closure and container in a fully closed condition. To open the closure 10 it is necessary first to place the closure in an opening condition by pressing the cover member 34 at point 14 directly above the groove or hinge 44. This causes the cover member 34 to fold between its first and second portions 46 and 48 as the second portion 48 pivots about fulcrum elements 50. This applies a radial force to plug 42 and collar 40 but plug 42 remains in orifice 38 because of the interference fit which requires an axial force to remove the plug from the dispensing orifice 38. As seen in FIG. 5 the plug 42 is shown as tilted in the orifice 38 with the edge 16 of the cap 18 lifted above the level of the upper lip 30. The resiliency of the material is such that if the edge 16 of the cover member 34 is not grasped to complete the opening sequence and pressure is released from above the hinge 44, the cover member 34 will return to its fully closed position.

With pressure applied to point 14 and the edge 16 of the cover member 34 spaced above the edge of the lip 30 as seen in FIG. 5, the cover member 34 may be gripped between the fingers and lifted upwardly to produce the axial force required to remove the plug 42 from its position in the dispensing orifice 38. The application of the radial force to the plug 42 during the initial condition of opening as opposed to the axial force required to remove the plug from its orifice is insured by arranging the fulcrum elements 50 on a line passing through the plug 42. This minimizes the transfer of any axial forces that might tend to remove the plug 42 and maintains it in a sealed condition in the orifice 38.

In actual practice and depending on the wall thickness the plug 42 may be deflected relative to the remainder of the cover 38 while the cover member 34 is being placed in an opening position as illustrated in FIG. 5. On the other hand the plug 42 may have flexibility to permit its deflection. Also the orifice 38 may be distorted into a slightly oval shape. In still other instances a combination of these distortions and deflections can be permitted with all achieving substantially the same result, namely, maintaining the plug 42 in sealing engagement in the dispensing orifice 38.

After the cover member 34 has been pivoted about its hinge 36 to a fully opened position such as that shown in FIG. 2, the contents of the container 12 can be dispensed through the orifice 38. To reclose the closure and seal the orifice 38 the cover member 34 is moved relative to the cap 18 about the hinge 36 which will bring the end of the plug 42 into alignment with the orifice 38. Subsequent pressing of the cover member will push the plug 42 into sealing engagement with the orifice 38 and position the cover 34 flush with the upper edge 30 of the skirt 20 to the original, fully closed position requiring a repetition of the pressing and lifting actions where the closure is to be opened.

Referring now to FIGS. 6 through 9, another embodiment of the invention is shown in which a closure 60 has a cylindrical skirt 62 with a flat disc shaped wall 64 recessed slightly below the upper edge of the skirt 62 to form a cavity 66. The cavity 66 is closed by a cover member 68 hinged at 70. The top wall 64 is provided with a dispensing orifice 72 which in a closed position of the closure 60 is closed with a plug 74. The plug 74 is formed on a tab 76 hinged to the cover member 68 along one edge as indicated at 78. The cover member 68 also is provided with a secondary hinge 80 by which the cover member 68 can be folded between first and second portions 82 and 84, respectively.

Figure 9:
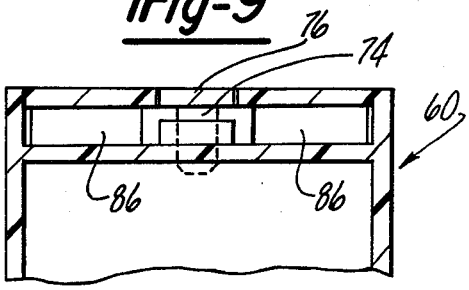
FIG. 9 is a cross-sectional view taken on line 9—9 in FIG. 6 when the closure is in a fully closed position.

The top wall 64 is provided with a pair of fulcrum elements 86 which in the closed position of the closure 10 are disposed to opposite sides of the tab 76 as seen in FIG. 9.

Figure 8:
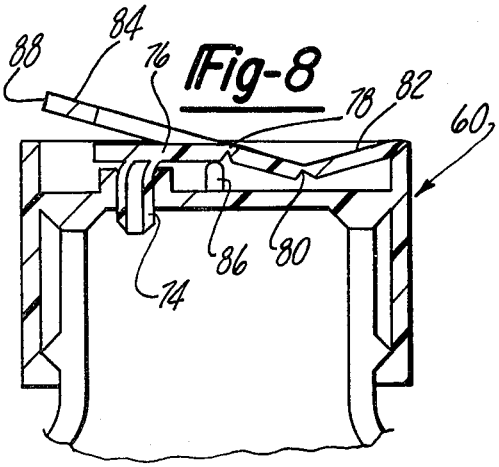
FIG. 8 is a view similar to FIG. 5 showing an opening condition of the closure seen in FIGS. 6 and 7.

In this embodiment of the invention the closure 60 also is permanently attached to the neck 26 of a container 12 and opening of the container requires removal of the plug 74 from the orifice 72. Both the cover member 68 and the tab 76 are flat in the closed position of the closure 10 so that no gripping edges are exposed. To open the closure 60 it is necessary to apply pressure at a point above the hinge 80 as seen in FIG. 8. This causes the cover member 68 to fold between the first and second portions 82 and 84 and to tilt the second portion 84 about the fulcrum elements 86. However, the fulcrum elements 86 are ineffective on a tab 76 which causes the tab to fold about the hinge 78 leaving the plug 74 in the dispensing orifice 72. As in the prior embodiment of the invention, either the plug 74 or the orifice 72 may deform during the initial opening movement because of the application of a substantially radially directed as opposed to an axial directed force to the plug. Under any of those conditions the orifice 72 remains sealed and the edge 88 of the cover member 68 is raised above the edge of the cylindrical skirt 62 to place it in a position where it may be grasped between the fingers. Thereafter the cover member 68 can be swung about the primary hinge 70 to a fully opened position during which time the plug 74 is removed from the orifice 72 by the application of a substantial axial force.

In the fully open position of the closure 60, the contents of the container 12 can be dispensed through the orifice 72. When it is desired to close the closure 60, the cover member 68 is pivoted about the hinge 70 which causes the plug 74 to come into alignment with the orifice 72. Subsequent pressure on top of the cover member 68 will press the plug 74 into the orifice 72 to reseal the contents of the container 12.

Two embodiments of a one piece child resistant closure have been provided which requires pressing of the closure in a specific location to tilt a portion of a cover member to a position where it can be grasped during which time a dispensing orifice remains closed and sealed by a plug. Fulcrum elements about which the cover member pivots to expose the gripping edge are so arranged that they are ineffective to transmit any axial force to the plug by which it can be removed from the orifice. In one embodiment of the invention the fulcrum elements are on a line passing through the plug and in the other embodiment the plug is formed on a tab and the pivot elements are so arranged that they are effective only on the cover member but not on the tab. In both embodiments of the invention the initial opening movement tends to distort the closure so that if the pressing force is removed before the closure is fully opened the cover member will return to its originally fully closed position.

The embodiments of the inventions in which an exclusive property or privilege is claimed are defined as follows:

1. A one piece child resistant closure for containers comprising: a cap member adapted to be permanently attached to a container and having a recess in its upper end, a cover member closing said recess in said cap member and formed integrally therewith for hinging movement about a first hinge at one edge, a dispensing orifice formed in said recess of said cap member and communicating with said container, plug means for said dispensing orifice moveable from a position in which said orifice is closed to a position to a position in which said orifice is opened upon swinging of said cover member about said first hinge to a fully opened position, a second hinge between said plug and said first hinge dividing said cover member into relatively foldable first and second portions, means forming a fulcrum for said second portion on a selected one of said member spaced from second hinge and adjacent said plug means, said second portion of said cover member being tiltable about said fulcrum while said plug means remain in a position closing said orifice during application of a pressing force to said cover member adjacent said second hinge to elevate an edge of said second portion from said recess to a lifting position, said lifting position permitting gripping of said second portion for swinging of said cover member about said first hinge to move said plug means and open said orifice.

2. The child resistant closure of claim 1 wherein said means forming a fulcrum includes a pair of fulcrum elements spaced to opposite sides of a plane passing through said plug means and orifice.

3. The one piece child resistant closure of claim 1 wherein said means forming said fulcrum includes a pair of fulcrum elements affording pivoting of said second portion of said cover member on a line parallel to said second hinge and passing through said plug means.

4. The child resistant closure of claim 1 wherein said plug means includes a tab hinge relative to said second portion of said cover member and a plug element formed integrally with said tab.

5. The child resistant closure of claim 1 wherein said plug means includes a plug element extending axially from said second portion of said cover member and wherein said fulcrum elements are disposed on a line passing through said plug element.

6. A one-piece child resistant closure for containers comprising: a cap member adapted to be permanently attached to a container and having a recess in its upper end, a cover member closing said recess in said cap member and formed integrally therewith for hinging movement about a first hinge at one edge, a dispensing orifice formed in said recess of said cap member and communicating with said container, a plug for said dispensing orifice formed integrally with said cover member and being removable axially between closed and open positions upon swinging of said cover member about said first hinge, said cover number being deflectable between relatively foldable first and second portions, means forming a fulcrum for said second portion on one of said members said second portion of said cover member being tiltable about said fulcrum upon application of a pressing form to said cover member between said first and second portions to elevate an edge of said second portion from said recess to a lifting position and means preventing application of an axial opening force to said plug upon tilting of said second portion to said lifting position while maintaining said plug sealed in said dispensing orifice, said lifting position permitting gripping of said second portion for swinging said cover member to an opened position about said first hinge to remove said plug from said orifice.

7. The one piece child resistant closure of claim 1 wherein said plug is formed on said second portion and wherein said means preventing application of an opening force includes a gap in said fulcrum, said plug being disposed in said gap when said cover member is in the closed position to prevent transfer of an opening force to said plug and maintain the latter in sealing engagement with said dispensing orifice upon tilting movement of said second portion to said lifting position.

8. The one piece child resistant closure of claim 1 wherein a tab is formed on said second portion for hinging movement relative thereto, said plug being formed integrally with said tab for movement therewith, said means preventing application of an opening force to said plug including a gap in said fulcrum for receiving said tab to prevent transfer of an opening force to said tab and maintain said plug in sealing engagement with said dispensing orifice during tilting movement of said second portion relative to said fulcrum to a lifting position.

9. The child resistant closure of claim 1 wherein said means forming a fulcrum includes a fulcrum element formed on one of said members for engagement with the other of said members upon movement of said second portion to an opening position.

10. The child resistant closure of claim 1 wherein a selected one or both of said plug and dispensing orifice are resiliently deflectable and remain in sealing engagement upon movement of said second portion to a lifting position to return said second portion to a closed position upon release of said pressing force prior to lifting said second portion.

11. The child resistant closure of claim 4 wherein said plug extends axially from said second portion and wherein application of a pressing force to said cover member applies a substantially radially directed force to said plug maintaining said plug in said orifice.

* * * * *